US006698973B2

(12) United States Patent
Suatac

(10) Patent No.: US 6,698,973 B2
(45) Date of Patent: Mar. 2, 2004

(54) ADJUSTABLE MANHOLE COVER ASSEMBLY

(76) Inventor: Ismail Cemil Suatac, 70 McEwen Avenue, Apt. 1108, Ottawa, Ontario (CA), K2B 5M3

( * ) Notice: Subject to any disclaimer, the term of this patent is extended or adjusted under 35 U.S.C. 154(b) by 0 days.

(21) Appl. No.: 09/935,723

(22) Filed: Aug. 24, 2001

(65) Prior Publication Data

US 2002/0025223 A1 Feb. 28, 2002

(30) Foreign Application Priority Data

Aug. 30, 2000 (CA) ..... 2317317

(51) Int. Cl.[7] ..... E02D 29/14
(52) U.S. Cl. ..... 404/26
(58) Field of Search ..... 404/25, 26; 52/20, 52/19

(56) References Cited

U.S. PATENT DOCUMENTS

| | | | | | |
|---|---|---|---|---|---|
| 2,593,918 | A | * | 4/1952 | Redmon | 404/26 |
| 3,533,199 | A | | 10/1970 | Pickett | |
| 3,629,981 | A | | 12/1971 | McCaffrey | |
| 3,930,739 | A | | 1/1976 | Larsson et al. | |
| 4,075,796 | A | | 2/1978 | Cuozzo | |
| 4,149,816 | A | | 4/1979 | Piso | |
| 4,337,005 | A | * | 6/1982 | LeBaron | 404/26 |
| 4,475,844 | A | * | 10/1984 | Arntyr et al. | 404/2 |
| 4,614,065 | A | * | 9/1986 | Papp | 52/20 |
| 4,925,337 | A | | 5/1990 | Spiess et al. | |
| 5,044,674 | A | * | 9/1991 | Hendrickson | 285/147.1 |
| 5,095,667 | A | | 3/1992 | Ryan et al. | |
| 5,344,253 | A | | 9/1994 | Sacchetti | |
| 5,360,131 | A | * | 11/1994 | Phillipps et al. | 220/8 |
| 5,451,119 | A | * | 9/1995 | Hondulas | 404/25 |
| 6,179,518 | B1 | * | 1/2001 | Suatac | 404/26 |
| 6,311,433 | B1 | * | 11/2001 | Zdroik | 52/20 |

FOREIGN PATENT DOCUMENTS

| | | | | |
|---|---|---|---|---|
| AT | 397 116 | | 2/1994 | |
| CH | 435 135 | | 4/1967 | |
| DE | 35 37 956 | | 5/1987 | |
| EP | 0536100 | A1 * | 4/1993 | E02D/29/14 |
| FR | 2 119 178 | | 8/1972 | |
| JP | 09132923 | | 5/1997 | |

* cited by examiner

*Primary Examiner*—Thomas B. Will
*Assistant Examiner*—Kristine Florio
(74) *Attorney, Agent, or Firm*—Thomas Adams

(57) ABSTRACT

An adjustable manhole cover frame assembly suitable for mounting on a manhole basin upper section has an outer ring, capable of resting on the top surface of the upper section, and an inner ring engaging the outer ring by screw threads and having support for a manhole cover. The lower surface of the frame assembly has a part spherically curved surface resting on a similarly curved surface of the manhole basin upper section and which allows the orientation of the frame assembly to be adjusted. Also, the frame assembly itself may have parts with part spherical mating surfaces allowing an upper part to be adjusted for slope when the remainder of the frame assembly has been fixed.

8 Claims, 5 Drawing Sheets

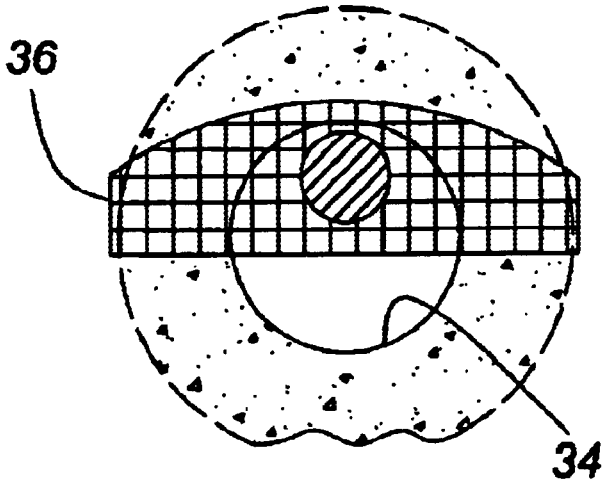
FIG. 3
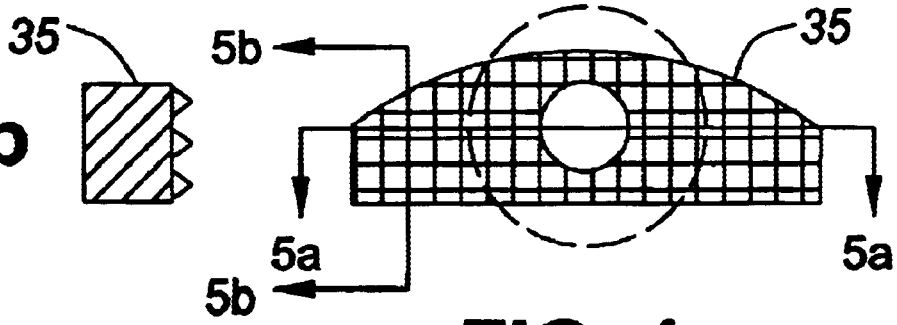
FIG. 5b
FIG. 4
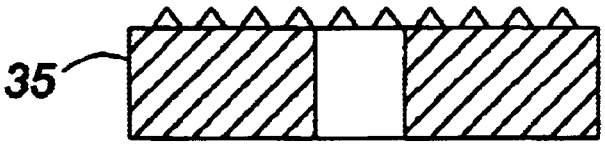
FIG. 5a

ADJUSTABLE MANHOLE COVER ASSEMBLY

BACKGROUND OF THE INVENTION

1. Field of the Invention

The present invention relates to a manhole cover assembly for mounting a manhole cover above a manhole basin. The invention is applicable to adjustment of the slope of the manhole cover, and usually also its height, as necessitated by resurfacing a road surface and/or by frost heave of the surrounding ground.

2. Prior Art

Manhole basins, which may be a sewer basin having an inlet and an outlet, or may be a catchment basin having only an inlet, are normally cast of concrete. A frame of metal is fixed to the top of the concrete basin and holds the manhole cover. In order to keep the cover level with a road or ground surface it is frequently necessary to alter the height between the manhole cover and the top of the basin, particularly in regions where there is much frost heave; adjustment to the height is usually done when a road is resurfaced. Adjustment of slope may also be necessary, as when the camber of a road is changed. In addition, adjustment of the lateral position may be necessary, especially with catchment basins where the manhole must be positioned accurately close to a curb.

Various constructions of adjustable manhole frames have been proposed to deal with height adjustment and to avoid replacing concrete parts. In some cases, screw jacks have been used between the annular frame which holds the cover and the top of the concrete manhole basin. In others, an outer ring, supported by the basin, has internal helical threads of large diameter within which is an inner ring having mating screw threads, and which is rotatable to adjust its height. Examples of patents showing such systems are:

- U.S. Pat. No. 3,533,199, which issued Oct. 13, 1970 to Pickett;
- U.S. Pat. No. 3,629,981, which issued Dec. 28, 1971 to McCaffrey;
- U.S. Pat. No. 4,075,796, which issued Feb. 28, 1978 to Cuozzo;
- U.S. Pat. No. 5,095,667, which issued Mar. 17, 1992 to Ryan et al.; and
- U.S. Pat. No. 5,344,253, which issued Sept. 6, 1994 to Sacchetti.

All the above patents are concerned with height adjustment, and show little or no provision for slope adjustment. Most of the patents show upper and lower parts of the frame assembly to be connected by helical threads surrounding the annular upper portion of the frame so that rotation of this upper portion changes its height without any change to its slope. However, some other patents show jack-type screw adjusters which are spaced around the frame and which can be adjusted individually to alter the slope, as well as the height, of the upper frame portion. Such arrangements are shown in the following patents.

- U.S. Pat. No. 3,930,739, which issued Jan. 6, 1976 to Larsson et al,;
- U.S. Pat. No. 4,149,816, which issued Apr. 17, 1979 to Piso; and
- U.S. Pat. No. 4,925,337, which issued May 15, 1990 to Spiess et al.

These prior arrangements would appear to have some drawbacks. In particular, they seem to offer only limited slope adjustment. This is especially true of Piso, where more than slight change of slope would seemingly cause binding in the adjusting screws. In Larsson et al. and Spiess et al., the amount of slope adjustment would be limited by binding between outer edges of the upper frame portion and the fixed surrounding structure. Also, these prior patents do not show any seals which would prevent ingress of soil or other material into the mechanical parts if there were to be significant slope adjustment. Larsson et al, and Piso show small seals which would accommodate only a small amount of slope adjustment, while Spiess et al. show no seal at all.

It is an object of this invention to provide an adjustable manhole assembly in which substantial slope adjustment of the manhole cover is possible.

A further object of embodiments of the invention is to provide a joint arrangement which can maintain a seal against soil and other material entering the manhole basin even when substantial adjustments are made.

SUMMARY OF THE INVENTION

The present invention overcomes the deficiencies of the prior art in relation to slope adjustment by providing at least one part-spherical mating surface between an upper part of the assembly which is subject to slope adjustment and a lower part which remains stationary.

Preferably, the slope adjustment does not separate the mating surfaces.

In a preferred embodiment, the invention allows lateral adjustment of the cover position such as will allow the cover to be set a precise distance from the curb.

In accordance with one aspect of the invention, an adjustable manhole basin cover assembly including an upper section of an annular manhole basin comprises:

- an upper annular part having a recess for receiving a manhole cover and adapted to mate with an underlying annular surface which is also part of the assembly, the upper annular part and the underlying annular surface having mating surfaces,
- wherein at least one of the mating surfaces is part spherical, whereby the upper annular part may be adjusted in slope relative to the upper manhole basin section while maintaining a sealing relationship between the mating surfaces.

Preferably, both of the mating surfaces are part spherical. Also, the mating surfaces are preferably surrounded by a sealing collar to minimize entry of soil or other matter between these surfaces.

The upper annular part may be an adjustable frame assembly for variably spacing the manhole cover above a conventional concrete manhole upper section, in which case the concrete manhole basin upper section and the bottom of the frame assembly have the part spherical mating surfaces.

Alternatively, the upper annular part may be an upper portion of the adjustable frame assembly, and the part spherical mating surfaces are provided between the upper portion and a lower portion of the frame assembly.

Preferably, spherical mating surfaces are used both between the manhole basin upper section and the frame assembly, and between upper and lower portions of the frame assembly. The lower mating surfaces between the manhole basin upper section and the frame assembly provide a coarse adjustment, while the upper mating surfaces between the upper and lower portions of the frame assembly provide a fine adjustment. The provision of two slope adjustments, by the upper and lower pairs of mating surfaces, also has the advantage that the adjustments can be combined to give some lateral adjustment of the upper portion of the frame assembly.

A greater degree of lateral adjustment may be provided by a modified construction in which the precast manhole basin upper section, which has one of the part spherical mating surfaces, is in the form of a precast adapter ring resting on a manhole basin upper section with an annular upper surface, which may be the conventional flat top of a manhole upper section. In this case the manhole cover assembly of this invention can be considered as including this adapter ring as well as the frame assembly resting on it. For the lateral adjustment, the precast adapter ring has its annular top surface formed eccentrically to its lower surface so that the lateral position of the frame assembly relative to the manhole basin can be changed by rotating the precast adapter ring on the manhole basin.

According to a second aspect of the invention, an adjustable manhole cover assembly comprises:

a precast manhole basin upper section having an annular top surface, the upper section being in the form of a precast adapter ring having an annular top surface and annular lower surface, the annular lower surface being suitable for resting on a manhole basin with an annular upper surface; and a frame assembly having a recess for receiving a manhole cover, the frame assembly having an annular lower surface capable of resting on the annular top surface of the adapter ring so that the last-mentioned annular surfaces form mating surfaces, at least one of said mating surfaces being part-spherical so as to allow slope adjustment of the frame assembly relative to the adapter ring;

the precast adapter ring having annular top surface formed eccentrically to its lower surface so that the lateral position of the frame assembly relative to the manhole basin can be changed by rotating the precast adapter ring on the manhole basin.

Where the manhole cover assembly has an adjustable frame assembly with a recess for receiving a manhole cover, and has an annular lower surface capable of resting on an annular top surface of a precast manhole basin upper section, the adjustable frame assembly may have an inner frame movable within an outer frame for adjusting the height of the inner frame, and part spherical mating surfaces may be provided on upper and lower portions of the inner frame. As in prior art constructions, the inner frame may have external helical threads engaging internal screw threads of the outer frame, whereby these threads may be used to adjust the height of the inner frame relative to the outer frame for raising the height of the manhole cover support.

The invention may also provide a special locking arrangement for locking the manhole cover in place on the frame assembly.

BRIEF DESCRIPTION OF THE DRAWINGS

Preferred embodiments of the invention will now be described by way of example with reference to the accompanying drawings, in which;

FIG. 1 also indicates a jack used to adjust the slope of the frame assembly;

FIG. 3 is a view on lines 3—3 of FIG. 2*b* showing the underside of a locking nut and adjacent parts;

FIG. 4 is a view on lines 4—4 of FIG. 2*a*, showing a locking washer;

FIGS. 5*a* and 5*b* are, respectively, longitudinal and cross-sectional views of the locking washer of FIG. 4;

DETAILED DESCRIPTION

Figure 1:
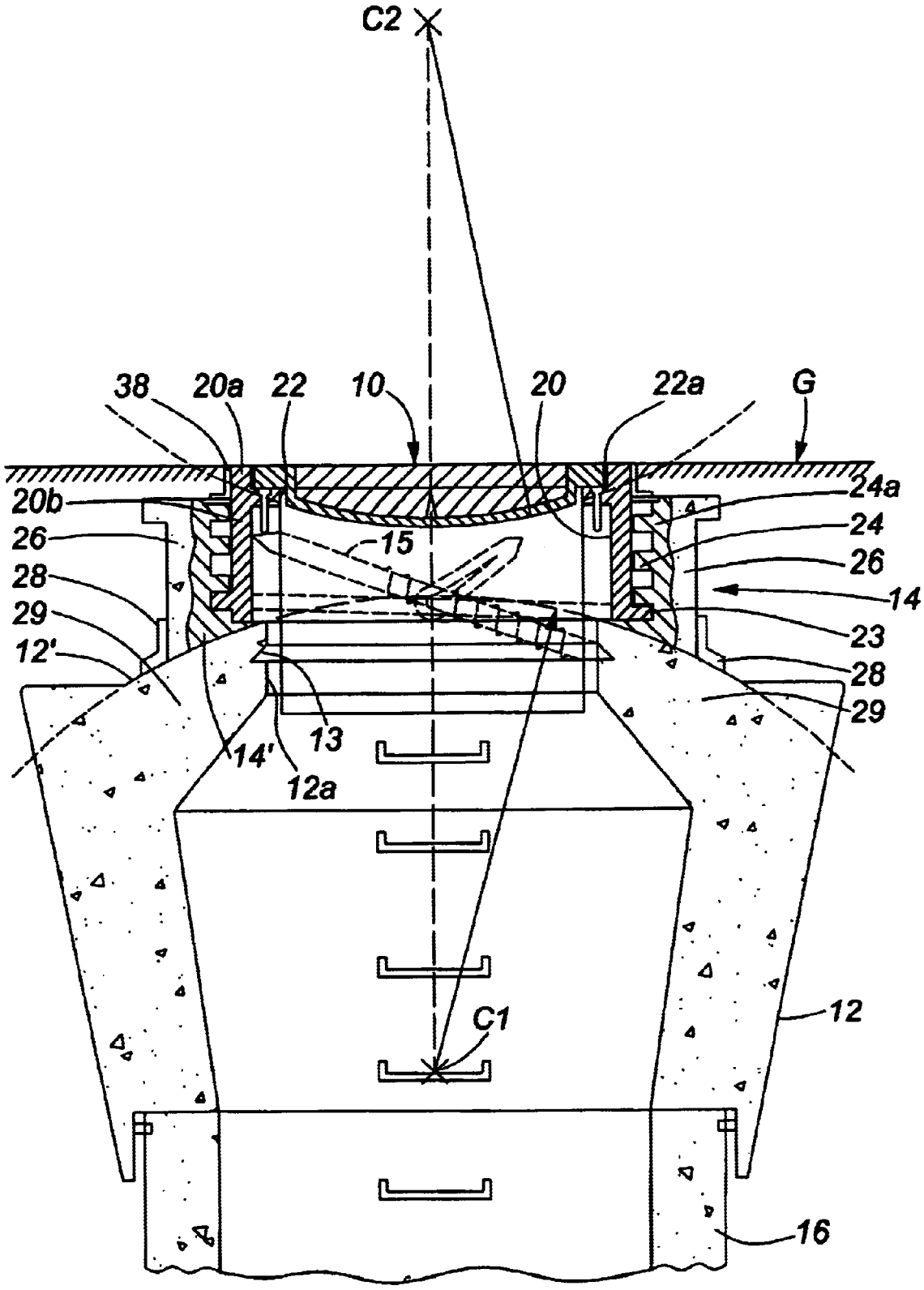
FIG. 1 is a sectional elevation of the upper part of a first embodiment of manhole basin having an adjustable manhole cover frame assembly in accordance with the invention.

FIG. 1 shows a manhole cover 10 supported on the top section 12 of a manhole basin by a manhole cover frame assembly 14 which is adjustable in accordance with this invention. The manhole basin of which the top precast section 12 is shown in FIG. 1 is cast of concrete, and has a cylindrical middle section 16 the top portion of which is shown, and which rests on a lower section which is not shown. The top section 12 rests telescopingly on the middle section 16. The invention allows adjustment of the height and slope of the cover 10 relative to the ground level G.

The frame assembly 14, in common with some prior art designs, has two parts formed of cast metal, firstly an inner, upper ring part 20 having an internal flange 22 providing a recess for the edge of the manhole cover 10 and having a surrounding helical thread 23, and secondly an outer, lower ring part 24 having an internal helical thread 24*a* which receives the thread 23. The inner ring thread 23 subtends just one complete 360° circle; rotation of the inner ring part relative to the normally stationary outer part adjusts its height in accordance with prior art procedures. The rotation can be done by conventional methods, for example by use of a special tool having depending spigots which fit into bores in the top of the ring part 20; these bores are described below with reference to FIG. 6. While some prior art frame assemblies have only the metal parts of the ring as described, here it is preferred that the outer ring part 24 be surrounded by a concrete collar 26 cast around the outer ring part 24, which reinforces this ring part and provides a larger mating area at the bottom of the frame assembly where it rests on the manhole top section 12.

Typically, in prior art designs, the top precast section 12 has a flat top and the frame assembly 14 would have a flat underside portion resting on this flat top and with a skirt overlapping the top section to provide a seal. However in this invention the upper end of the top section 12 and the lower surface of the frame assembly 14 have mating surfaces, 12' and 14' respectively, which are part spherical. As shown, the part spherical mating surfaces have a center of curvature C1 below the spatial center of the top manhole section 12. The mating surfaces are surrounded by a sealing collar 28 having a cylindrical part in contact with the outside of concrete collar 26 and a flared skirt in contact with the part spherical upper surface 12'. This sealing collar may be made of glass fiber reinforced polyester or stainless steel. This collar is intended to largely prevent soil or other dirt from entering between the mating surfaces, especially when frost lifts the outer concrete collar 26 and the ring part 24, and for this purpose, after the collar has been adjusted on the section 12, it may be secured to this section by nails indicated at 29 which will prevent the collar lifting off the surface 12'. The collar can be fixed in this way because the adjustment of slope at this joint is a coarse adjustment, and fine slope adjustment needed subsequently can be effected by the upper pair of mating surfaces to be described below. Nailing this collar in place also helps to prevent unwanted angular movement of the frame assembly during backfilling around this assembly.

As shown in FIG. 1, the top precast section 12 has its central aperture 12*a* provided with an annular notch or recess 13 with a generally horizontal lower surface. This notch can receive the lower end of a screw jack 15 shown in broken lines in FIG. 1, this jack having its upper end pushing against the upper portion of the opposite side of the inner ring 20 and serving to adjust the slope of the inner ring.

Figure 2A:
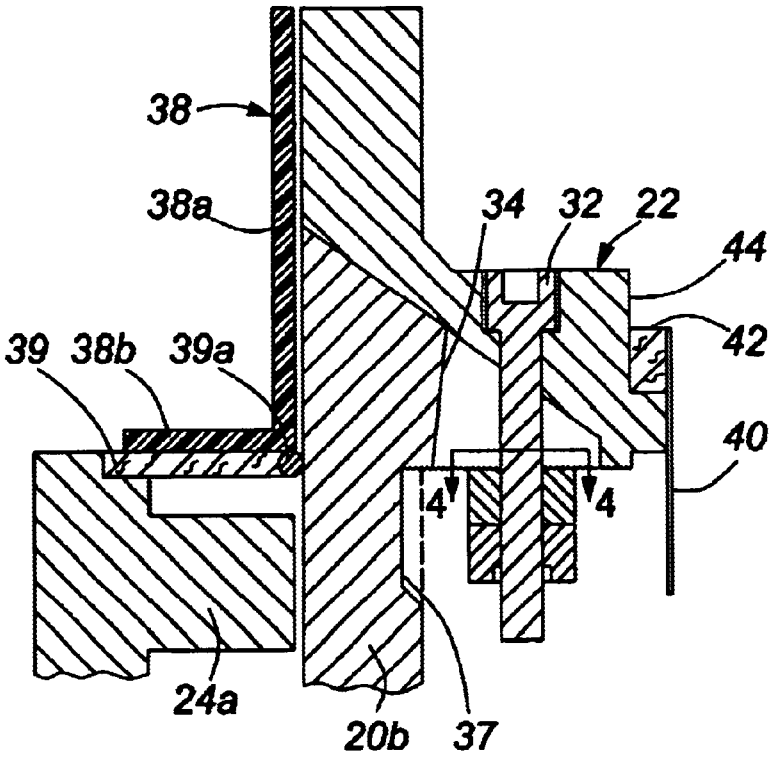
FIGS. 2*a* and 2*b* are enlarged sectional views of mating parts of upper and lower portions of the frame assembly shown in FIG. 1, in different positions of adjustment.
Figure 2B:
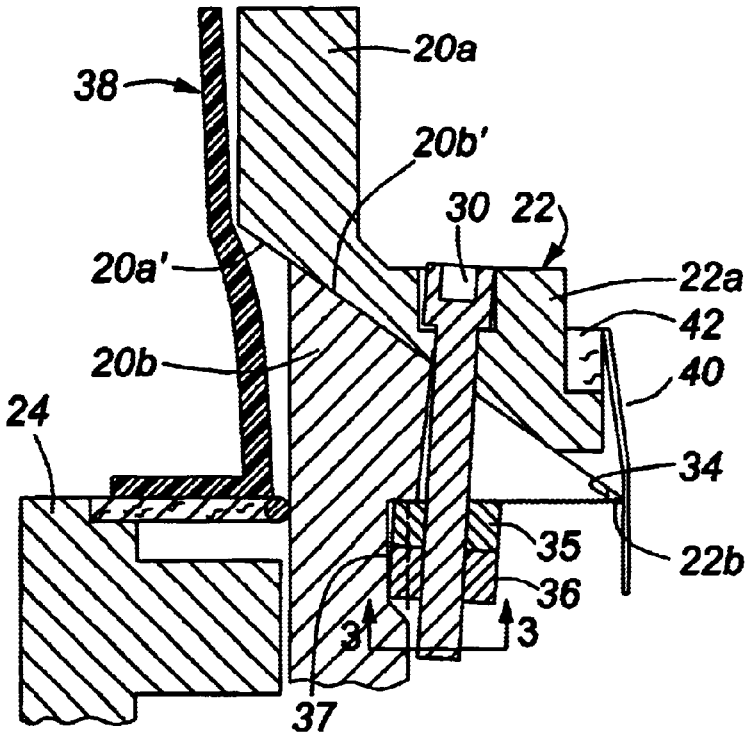

The inner ring 20 itself is formed of upper and lower portions 20*a* and 20*b,* which are also joined by part spherical mating surfaces, having a center of curvature indicated at C2 above the center of the manhole cover 10. Details of the joint are shown in FIGS. 2*a* and 2*b*, which show enlarged views of the mating parts. As shown, the upper inner ring flange 22 is effectively split to provide the part spherical mating surfaces 20*a*' and 20*b*', and the upper part 22*a* of the flange which is integral with the upper ring portion has a series of countersunk bores 30 for receiving the heads of screws 32. These screws pass through enlarged apertures 34 in the lower part 22*b* of the flange which is integral with the lower ring portion 20*b,* and also pass through elongated lock washers 35 retained by elongated nuts 36 As will be seen in FIGS. 3 and 4, the elongated washers 35 and nuts 36 are long enough to overlap the sides of the apertures 34 and long enough that the ends of the nuts and washers interfere with the inner sides of the part 20*b* to prevent them from rotating. The large apertures 34 allow radial movement of the screws when they have been loosened to allow adjustment of the upper ring portion 20*a* on the lower ring portion between the co-axial position shown in FIG. 2*a* and an eccentric position, such as shown in FIG. 2*b*. The outer sides of the nuts and washers are curved so that the screws 32 can come close to the adjacent surfaces of the lower ring part 20*b,* and to allow sufficient movement the outer sides of apertures 34 are sloped, as shown in FIG. 2*a*, and recesses 37 are provided to accommodate the nuts and washers in the manner shown in FIG. 2*b*.

As shown in FIGS. 5*a* and 5*b,* the upper surfaces of the lock washers 35 are roughened and cooperate with rough under surfaces of the areas surrounding the apertures 34. In addition to inhibiting rotation of the washers, these roughened surfaces help to prevent unwanted movement between the mating surfaces when the screws 32 have been tightened, which otherwise may occur due to traffic passing over the manhole cover which subjects the parts to considerable stress and might tend to move the parts while tension in the screw 32 is reduced.

In order to exclude dirt and asphalt from between the mating surfaces of parts 20*a* and 20*b*, a sealing collar 38 is provided with a cylindrical portion 38*a* surrounding the outer top of the ring portion 20*a*, and a bottom flange 38*b*. This flange lies on top of a washer 39 held in a recess at the top of the outer, lower ring part 24, and having its inner edge sealing against the outer side of the inner ring part 20*b* by means of O-ring 39*a,* Again, this collar 38 may be of glass fiber reinforced polyester. As seen in FIG. 2*b,* the collar is resilient enough to accommodate the movement of the upper ring portion 20*a* relative to the lower ring part 20*b*. When this movement occurs, bitumen will normally be holding the flange 38*b* of the seal, and the washer 39, in place so that dirt does not enter below the washer 39. The movement of the upper ring portion 20*a* will usually be limited to about 3° or 0.5 cm; the greater movement occurs between the mating surfaces 12' and 14'.

FIGS. 2*a* and 2*b* also show a dirt excluding barrier positioned internally of the screws and mating surfaces, this being provided by a cylindrical plastic skirt 40 which is suspended from its upper edge portion by a fiber ring 42 which fits within a recess 44 in the inner surface of the upper ring portion 20*a*. As seen in FIG. 1, this plastic skirt 40, which may be formed of various polymers, extends down to well below the lower pair of mating surfaces 12' and 14', and thus tends to exclude dirt from both the upper and lower pairs of spherical mating surfaces. Grease may be used around the screw threads 23 and 24, but not between the mating surfaces 12' and 14' or 20*a* and 20*b*. Since the rotation of the inner ring part 20*a* inside part 20*b,* to alter the manhole cover height, may tend to rotate the frame assembly on the concrete section 12, generally radial cooperating notches may be provided in the mating surfaces 12' and 14' to inhibit such rotation of the frame assembly.

In use, the mating surfaces 12' and 14' between the concrete section 12 and the frame assembly 14 may used to allow the frame assembly to be orientated vertically even if the concrete parts, after back filling, are found to be tilted. The mating surfaces between the frame parts 20*a* and 20*b* are usually adjusted at a later stage, after resurfacing of a road has occurred, and it is found that slope adjustment is needed. This involves loosening screws 32, moving the upper portion 20*a* so that screws 32 slide along the apertures 34, and then tightening the screws. The upper, inner frame part 20 can also be rotated as needed to bring the manhole cover up to the road level.

Figure 6:
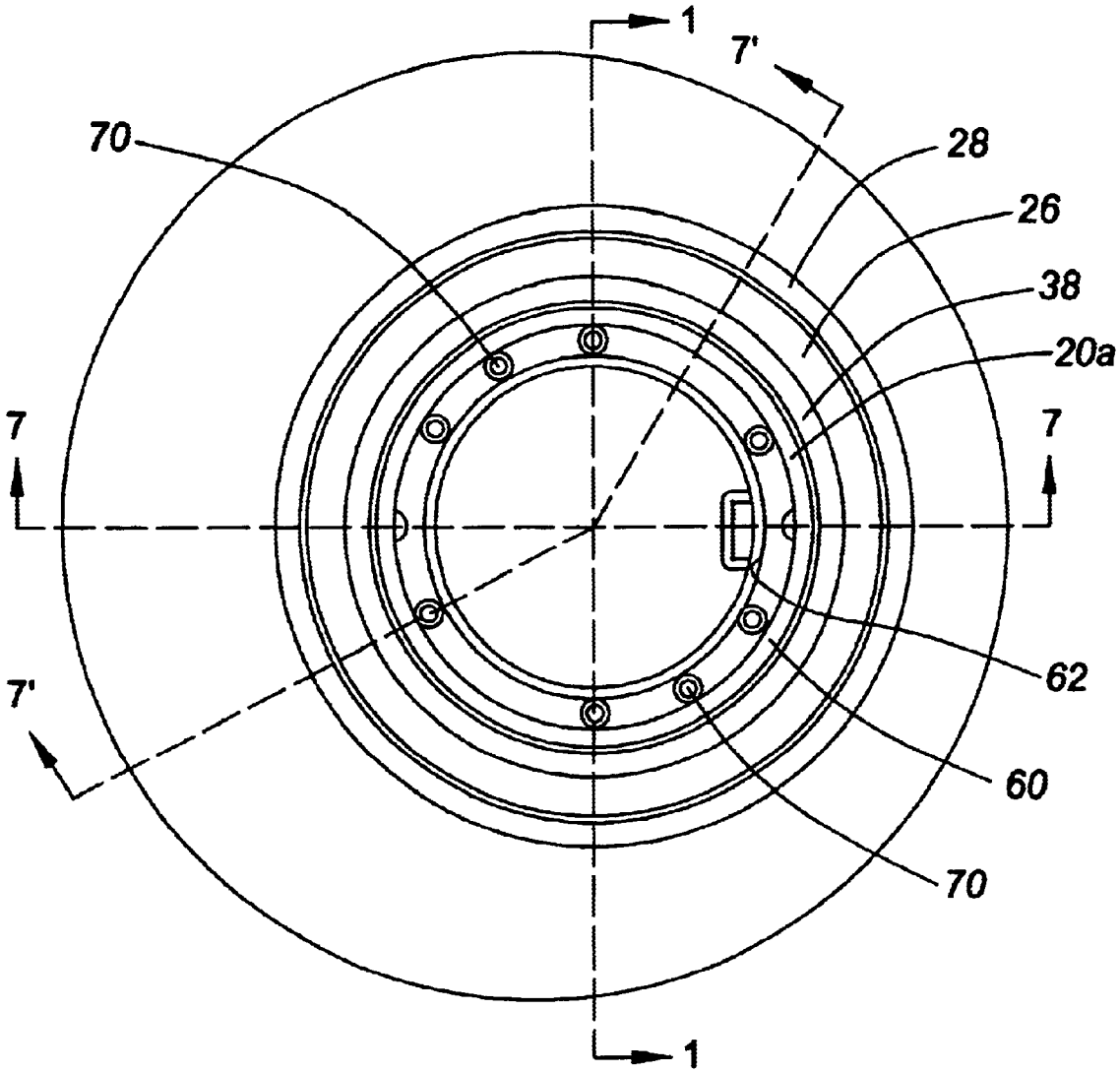
FIG. 6 is a top view of a modified form of the frame assembly with the cover removed.
Figures 7, 7A:
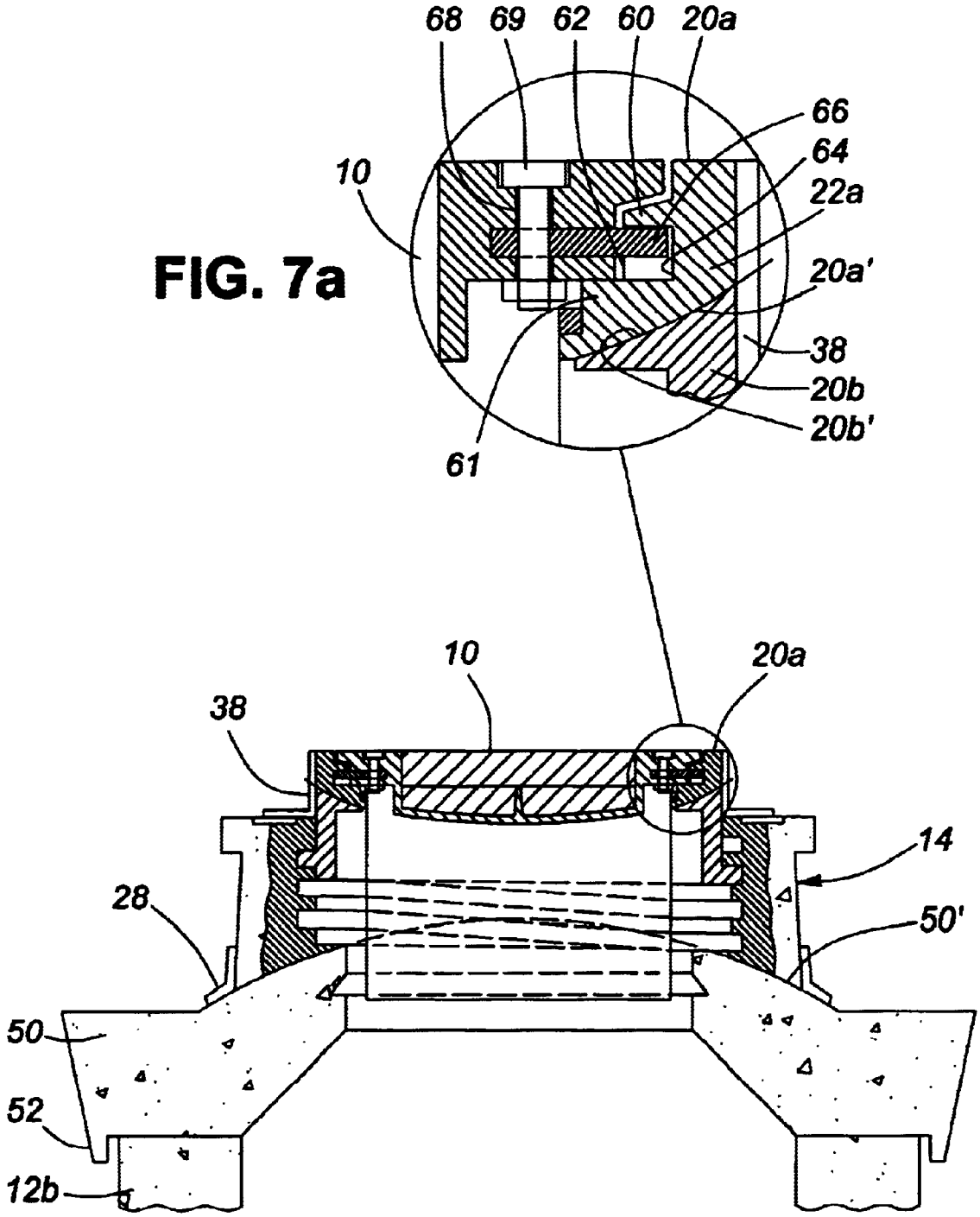
FIG. 7 is a sectional elevation on the frame assembly of FIG. 6, the lower part being taken on lines 7—7 of FIG. 6, and the upper part being taken on lines 7'—7' of FIG. 6.
FIG. 7*a* is an enlarged fragmentary view of parts of the assembly shown in FIG. 7.

FIGS. 6, 7 and 7*a* show details of a similar construction, but one in which the manhole basin top section 12*a* has a conventional flat top, and in which the upper mating surface of this top section is provided by a precast concrete adapter ring 50 with a flat undersurface and an outer depending skirt 52 which locates on the outer surface of the manhole top portion 12*a*. The adapter ring has a dome shaped top providing the part spherical lower mating surface 50' which receives the frame assembly 14, which is similar to that of the previous embodiment.

The only difference between the frame assembly and that of the previous embodiment is the provision of a locking mechanism for locking the cover 10 to the upper ring portion 20*a;* an enlarged view of the coacting parts is shown in FIG. 7*a*. As shown the upper ring part 20*a* has its flange 22*a* divided into upper and lower portions 60 and 61 joined by an inwards facing cylindrical surface 62; the outer edge of the cover 10 has a complementary shape. This surface 62 communicates with two part-circular side recesses 64 having horizontal upper and lower surfaces, these recesses being diametrically opposed on opposite sides of the ring part 20*a* as indicated in FIG. 6. These side recesses are each arranged to accommodate a D-shaped locking element or pawl 66 which is rotatable on a vertical shaft 68 held in a vertical bore near the outer edge of the cover 10, and the top of which has a non-circular socket 69 for receiving a key for rotating the shaft and for locking or unlocking the cover. The non-circular socket is preferably an 8 or 10 sided socket so that it can only be rotated by using a special and unusual key, to prevent tampering.

It will be clear that the locking parts and side recess could be alternatively arranged differently between the coacting parts,; i.e. the rotatable parts could be provided in the stationary ring part rather than in the cover, FIG. 6 also shows two diametrically opposed vertical bores 70 for receiving spigots of a tool which is used for rotating the upper ring part 20 relative to the lower ring part, for height adjustment, as mentioned above.

Although the invention has been described as having two sets of part-spherical mating surfaces, a simple version of the invention may be made with only one pair of mating surfaces, or even with only one part spherical surface which can slide on a complementary mating surface in such a way as to maintain contact between the mating surfaces during slope adjustment. For example, the two parts 20*a* and 20*b* of the upper ring may provide all of the slope adjustment, with the lower surface of the frame assembly being flat and resting on a flat concrete upper section.

I claim:

1. An adjustable manhole assembly comprising:

an adjustable frame assembly having a recess for receiving a manhole basin cover, said frame assembly having an annular lower surface capable of resting on an annular top surface of a precast manhole basin upper section;

said adjustable frame assembly having an inner frame movable within an outer frame for adjusting the height of the inner frame; and said inner frame having an upper portion and a lower portion with mating surfaces;

wherein one of said mating surfaces is part spherical, whereby said upper portion of the inner frame may be adjusted in slope relative to the lower portion of the inner frame while maintaining a sealing relationship between said mating surfaces.

2. A manhole assembly according to claim 1, wherein both of said mating surfaces are part spherical.

3. A manhole assembly according to claim 1, wherein said inner frame has external screw threads engaging internal screw threads of said outer frame, whereby said threads may be used to adjust the height of the inner frame relative to the outer frame for raising the height of the manhole cover support means.

4. A manhole assembly according to claim 1, wherein screws connect the said upper and lower portions of the inner frame, said screws passing through enlarged apertures in a flange of the lower portion so as to be movable in said apertures to allow adjustment of the upper frame portion.

5. A manhole assembly according to claim 1, wherein said inner frame has a skirt depending within said inner frame and positioned to protect said mating surfaces and associated parts from material passing through the manhole.

6. An adjustable manhole cover assembly comprising:

a precast manhole basin upper section having an annular top surface;

a adjustable frame assembly having a recess for receiving a manhole cover, said frame assembly having an annular lower surface capable of resting on said annular top surface so that said annular surfaces form mating surfaces;

wherein at least one of said mating surfaces of the manhole basin upper section and the frame assembly lower surface is part spherical, whereby said frame assembly may be adjusted in slope relative to the manhole basin upper section while maintaining a sealing relationship between said mating surfaces;

said adjustable frame assembly has an inner frame movable within an outer frame for adjusting the height of the inner frame;

said inner frame having an upper portion and a lower portion with further mating surfaces; and wherein at least one of said further mating surfaces is part spherical, whereby said upper portion of the inner frame may be adjusted in slope relative to the lower portion of the inner frame while maintaining a sealing relationship between said mating surfaces.

7. A manhole assembly according to claim 6, wherein all of said mating surfaces are part spherical.

8. An adjustable manhole cover assembly including an upper section of an annular manhole basin, comprising:

an upper annular part having a recess for receiving a manhole cover and adapted to mate with an underlying annular surface which is also part of said assembly, said upper annular part and said underlying annular surface having mating surfaces, and a manhole cover for fitting in said recess;

at least one of said mating surfaces being part spherical, whereby said upper annular part may be adjusted in slope relative to the said upper manhole basin section while maintaining a sealing relationship between said mating surfaces;

and said manhole cover and recess having coacting parts with locking means including a vertical shaft rotatable in one of the coacting parts and carrying a locking element engageable within a side recess in the other coacting part, said shaft being rotatable by a key to rotate the locking element and engage it in the said side recess.

* * * * *